United States Patent [19]

Park

[11] Patent Number: 4,996,401

[45] Date of Patent: Feb. 26, 1991

[54] SWITCH

[75] Inventor: Sung-Taek Park, Inchon, Rep. of Korea

[73] Assignee: Prince Corporation, Holland, Mich.

[21] Appl. No.: 373,181

[22] Filed: Jun. 29, 1989

[51] Int. Cl.[5] ..... H01H 19/62

[52] U.S. Cl. ..... 200/527; 200/528; 200/274; 200/284

[58] Field of Search ..... 200/526, 527, 528, 273, 200/274, 570, 571, 284, 116, 260

[56] References Cited

U.S. PATENT DOCUMENTS

| | | | |
|---|---|---|---|
| 2,907,847 | 10/1959 | Grenier et al. | 200/303 |
| 2,930,859 | 3/1960 | Nolden et al. | 200/16 A |
| 3,204,067 | 8/1965 | Brown | 200/527 |
| 3,223,813 | 12/1965 | Lewandowski | 200/532 |
| 3,284,605 | 11/1966 | Anderson et al. | 200/284 X |
| 3,359,393 | 12/1967 | Anthony et al. | 200/571 |
| 3,586,810 | 6/1971 | Brown | 200/302.2 |
| 3,614,364 | 10/1971 | Bedocs | 200/345 |
| 3,694,603 | 9/1972 | Congelliere et al. | 200/526 |
| 3,790,734 | 2/1974 | Raab et al. | 200/302.2 |
| 3,803,342 | 4/1974 | Stearley et al. | 200/284 X |
| 3,829,633 | 8/1974 | Smith et al. | 200/16 A |
| 3,940,585 | 2/1976 | Schaad | 200/530 |
| 4,052,580 | 10/1977 | Stanish | 200/535 |
| 4,055,736 | 10/1977 | Congelliere | 200/16 A |
| 4,175,222 | 11/1979 | Buttner | 200/528 |
| 4,225,764 | 9/1980 | Buttner | 200/518 |
| 4,288,670 | 9/1981 | Buttner | 200/303 |
| 4,293,751 | 10/1981 | Van Benthuysen et al. | 200/527 |
| 4,308,440 | 12/1981 | Buttner | 200/303 |
| 4,317,015 | 2/1982 | Buttner et al. | 200/526 |
| 4,345,128 | 8/1982 | Buttner et al. | 200/526 |
| 4,495,391 | 1/1985 | Kitao et al. | 200/284 X |
| 4,506,124 | 3/1985 | Rose et al. | 200/528 |
| 4,585,914 | 4/1986 | Ohajhi et al. | 200/284 |
| 4,771,141 | 9/1988 | Flumignan et al. | 200/528 |

*Primary Examiner*—Henry J. Recla
*Assistant Examiner*—Glenn T. Barrett
*Attorney, Agent, or Firm*—Price, Heneveld, Cooper, DeWitt & Litton

[57] ABSTRACT

A push-button rachet mechanism switch is converted to a rotary wiping action for a moveable contact which includes one or more axial extending contact members. The moveable contact selectively engages one or more radially spaced fixed contacts and continuously engages a common conductor for selectively coupling the common conductor to one or more of the radially spaced fixed contacts to which other conductors are coupled.

14 Claims, 2 Drawing Sheets

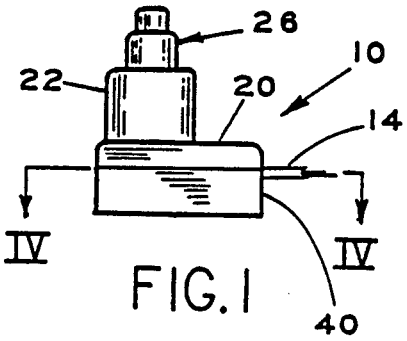
FIG. 1
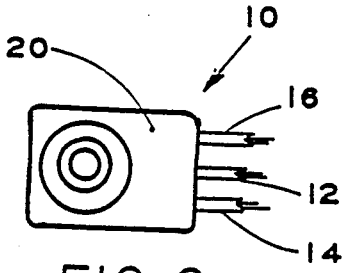
FIG. 2
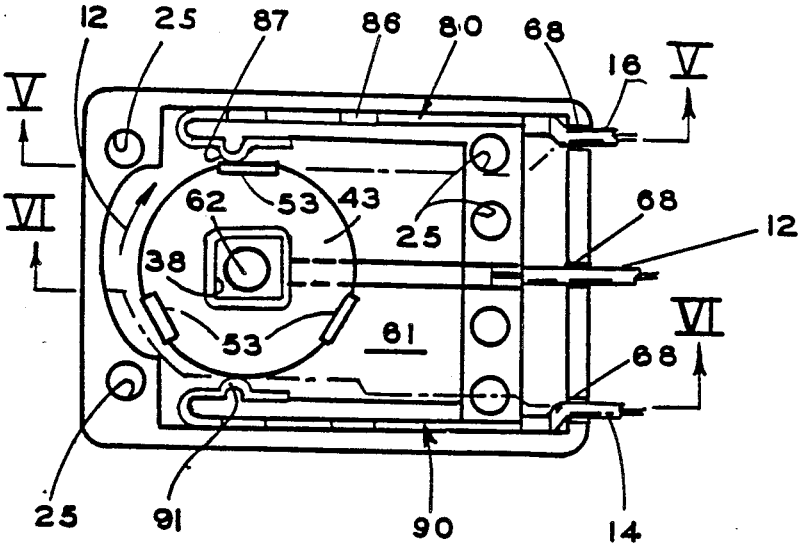
FIG. 4
FIG. 5
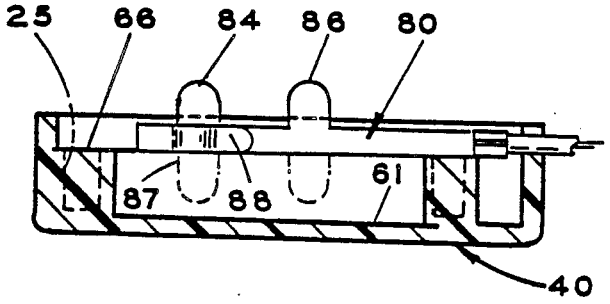
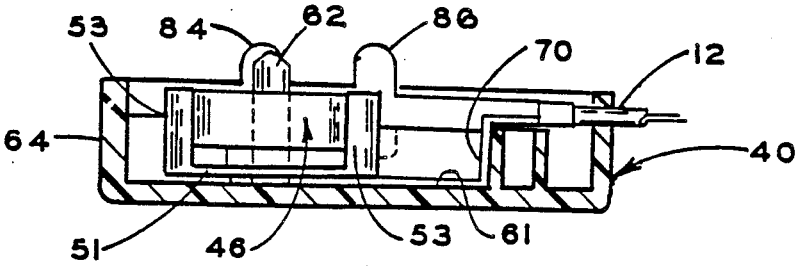
FIG. 6

SWITCH

BACKGROUND OF THE INVENTION

The present invention relates to a switch and particularly to a spring-loaded push-button switch with a rotary contact.

In the automotive industry push-button switches are used extensively for map lamps and other overhead lights inasmuch as the switching action is relatively easy to accomplish during the operation of a vehicle or as a passenger. There exists several patents on a wide variety of contact arrangements for such switches including U.S. Pat. No. 3,694,603 which discloses a rachet-type mechanism for rotating and extending and retracting a moveable contact. The difficultly with switches made according to the prior art are that with the rachet push-button mechanism employed, as a switch is actuated, the lights will momentarily flicker to an on or off position until the next stable position of the longitudinally moveable contact is reached. This is inherent in the nature of the rachet mechanism and the fact that the moveable contact typically extends beyond a stable position and then returns to a stable position. The flickering is somewhat objectionable to the user inasmuch as it appears that the switch is defective when in fact it is simply the nature of the switch operation.

Also with the rachet-type prior switch designs, the switch contacts themselves although providing some relative motion between the moveable and fixed contacts do not provide a self-cleaning wiping action to maintain the contacts clean and therefore improve the electrical conductivity between the moveable and fixed contacts.

SUMMARY OF THE PRESENT INVENTION

A switch of the present invention overcomes the deficiency of the prior art by providing a non-flickering positive contact switch in which the push-button rachet mechanism is converted to a rotary wiping action for a moveable contact which includes one or more contact members. The moveable contact is rotated with a rachet plunger mechanism and selectively engages one or more radially spaced fixed contacts and continuously engages a common conductor for selectively coupling the common conductor to one or more of the radially spaced fixed contacts to which other conductors are coupled. By converting the plunger action to a rotary action for making and breaking the switch contacts, the axial position of the plunger does not affect the switch action which therefore provides anti-flicker positive contact between the switch contacts. Further, by providing a rotary moveable switch contact which wipes the fixed contacts during operation, the contacts remain relatively clean and improves the conductivity between them for better switch operation.

These and other features, objects and advantages of the present invention will become apparent upon reading the following description thereof together with reference to the accompanying drawings in which:

BRIEF DESCRIPTION OF THE DRAWINGS

FIG. 1 is a side elevational view of a switch embodying the present invention;

FIG. 2 is a top plan view of the switch shown in FIG. 1;

FIG. 4 is a horizontal cross-sectional view of the switch shown in FIG. 1 taken along section lines IV—IV of FIG. 1;

FIG. 5 is a cross-sectional view of the switch taken along section lines V—V of FIG. 4; and FIG. 6 is a cross-sectional view of the switch taken along section lines VI—VI of FIG. 4.

DETAILED DESCRIPTION OF THE PREFERRED EMBODIMENT

Figure 3:
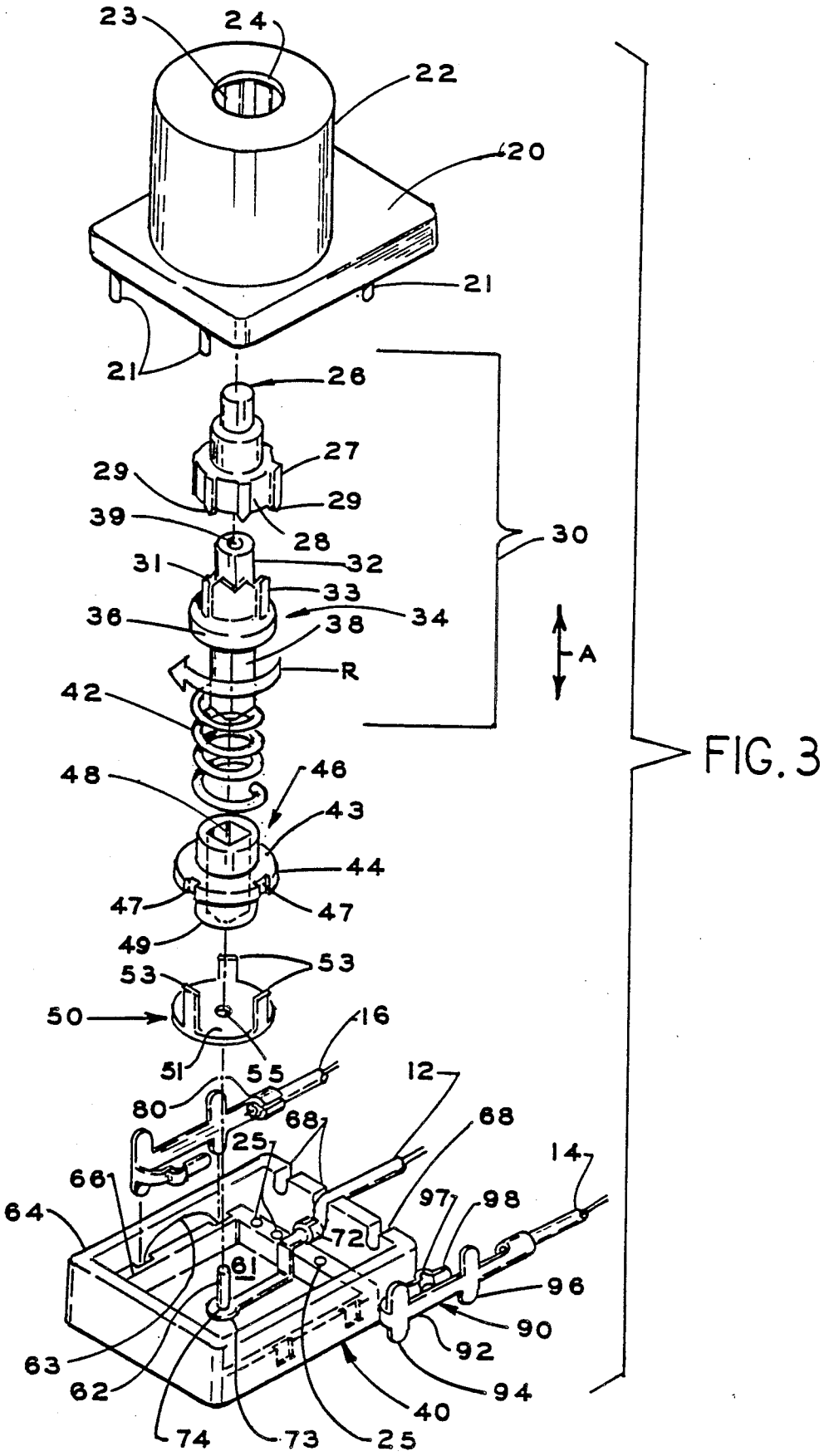
FIG. 3 is an enlarged exploded view of the switch shown in FIGS. 1 and 2.

The present invention comprises in the preferred embodiment a single pole double throw (SPDT) spring-loaded push-button switch 10 which has a center or common conductor 12 which is selectively electrically coupled by the switch to either of remaining conductors 14 or 16. Successive push operation of the switch effects the two different switching states. The application of this switch to automotive map lamps typically is to provide electrical power through conductor 12 either to conductor 14 coupled to an overhead map lamp with conductor 14 also being in series with a door operated switch so in the first position of switch 10, the overhead lamps will be illuminated only when the door is open. In the second switch position for example, conductor 16 is coupled directly to the lamp without the door switch interposed and the map lamp will be actuated regardless of the door position. Thus by providing a switch such as the single pole double throw switch 10 of the present invention, overhead map lamps can be used independently or as courtesy lamps in connection with the door operation.

Switch 10 of the preferred embodiment comprises a first or upper housing 20 including a cylindrical portion 22 with a central axially extending aperture 24 extending therethrough for receiving the plunger 26 of a rachet-type actuator mechanism 30. The cylindrical portion 22 of housing 20 includes internal longitudinally extending grooves 23 which align with guide bars 27 extending axially in equally spaced relationship on the outer periphery of a lower section 28 of rachet 26 as best seen in FIG. 3. This construction allows plunger to move axially while restraining rotary movement.

Housing 20 is coupled to a lower housing 40 to which the fixed switch contacts are attached as described below by means of a plurality of tapered pins 21 extending downwardly from housing 20 into mating apertures 25 formed in housing 40 to provide a mechanical intercoupling of the two housings as seen in FIGS. 1 and 2. Although unnecessary, a bonding adhesive may also be applied to assure a firm mechanical connection.

The actuator mechanism 30 includes as noted above the plunger 26 with rachet guides 27 each of which having a pointed tip 29 thereon (FIG. 3). Plunger 26 includes a downwardly opening cylindrical central aperture for receiving the upper cylindrical end 32 of intermediate member 34 having an annular upper collar 33 with a plurality of notches 31 formed therein which mate with and respond to the tips 29 of push member 26. Member 34 also includes a central disc-shaped section 36 and a lower generally square section 38 which includes a central aperture 39 extending through the entire member. The square lower end 38 of member 34 is surrounded by a compression spring 42 to be compressibly held between the lower surface of collar 36 and the upper surface 43 of a collar 44 on a contact holding member 46.

Member 46 includes a rectangular aperture 48 extending therethrough for slideably fitting over square extension 38 in a keyed manner such that as member 38 rotates in a direction indicated by arrow R in FIG. 3, contact holder 46 also rotates therewith. In addition, as member 34 moves in an axial direction indicated by arrow A, member 46 remains stationary while the square section 38 is allowed to slide within aperture 48.

Holder 46 also includes a lower section 49 having a lower surface which butts against and engages the upper surface 51 of moveable contact 50 of switch 10. Around the collar section 44 of holder 46 there is formed three equally spaced radially inwardly extending notches 47 which receive and hold the upturned contact elements 53 of moveable contact 50 made of a conductive material such as copper or brass which is typically plated. Holder 46 as well as members 26 and 34 naturally are made of a suitable insulator preferably a polymeric material such as Nylon or the like as are housing members 20 and 40.

The moveable contact 50 includes a central aperture 55 for centering the contact over an upwardly extending cylindrical post 62 extending upwardly from the center of the floor 61 of lower housing 40 which includes an upwardly extending peripheral wall 64 with a interior peripheral ledge 66 extending therearound and into which the apertures 25 are formed. Also positioned over post 62 is the end 73 of a generally L-shaped contact member 70 to which conductor 12 is electrically and mechanically coupled by the crimp fitting 72. Contact 70 includes a circular end 73 with an aperture 74 formed therein for resting over post 62. The rear wall of lower housing 40 includes three spaced slots 68 into which the conductors 12, 14 and 16 extend as seen in FIGS. 3–6. Contact 70 is also made of electrically conductive material such as plated brass or copper and electrically engages the lower surface of moveable contact 50 which is indexed to and rotates with keyed contact holder 46 as plunger member 34 rotates. The height of member 46, it is noted, is sufficient to accommodate the vertical motion A of plunger member 34 activated by plunger 26 between the fully extended and downwardly pressed positions which actuates the rachet mechanism 30 to stopwise rotate member 34 to which contact holder 46 is keyed in a conventional manner as described in U.S. Pat. No. 3,694,603 the disclosure of which is incorporated herein by reference for such teaching.

Switch 10 also includes fixed contacts 80 and 90 which are identical to one another and are each generally U-shaped with an I-shaped leg for mounting to the housing. Contact 90 includes a central leg 92 with tips 94 and 96. Extending around and rearwardly from tip 94 is a curved contact section 98 which includes a dimple 97 formed thereon for contacting the contact sections 53 of moveable contact 50 when aligned. FIG. 4 shows a position of the switch with one of the contacts 53 contacting a similar dimple 87 on contact 80. Legs 94, 96 and corresponding legs 84 and 86 of contact 80 fit within slots 63 formed downwardly in the peripheral ledge 66 and spaced in aligned relationship with the contacts for indexably receiving and holding the contacts in position. Upper housing member 20 includes similarly shaped and aligned slots for captively holding the upper tips of the contacts therein.

Switch 10 is assembled by fixing contacts 70, 80 and 90 within the lower housing 40 placing moveable contact 50 over contact member 46 and assembling the plunger mechanism 30 including members plunger 26, intermediate member 34 and spring 42 onto and aligned with contact member 46 over pin 62 and placing the upper housing 20 thereover pressing to the two housing sections together until they interlock.

The operation of switch 10 is best understood by reference FIG. 4 which shows the rotary motion of member 43 and contacts 53 on moveable contact 50 thereon with reference to arrow R showing the rotary motion of the contact. For each depression of plunger 26 the rachet mechanism 30 translates the plunger action into a rotation of approximately 60° such that one of the equally space contacts 53 will alternately contact either contact 80 or contact 90 of the fixed contacts thereby interconnecting center conductor 12 with either conductor 14 or 16 on alternate successive strokes of plunger 26. Thus for example, in FIG. 4 contact 53 is engaged by contact 80 to intercouple conductors 12 and 16. With the next stroke of plunger 26, contact holder 43 and contact 50 thereon will rotate clockwise as viewed in FIG. 4 60° thereby disconnecting contact 80 from contact 50 and coupling contact 50 with contact 90 through the tip 53 shown in the lower right quadrant of the drawing FIG. 4 as it rotates into position over tip 97 of contact 90. This thus connects conductor 12 with conductor 14 through the interconnection of contact 70 and 50 and 50 and 90. As can be seen even though the rachet mechanism relies upon the operation of plunger 26 and associated follower 34 which moves axially in a direction indicated by arrow A beyond a stable position and then retracts to a stable rotated position, the sliding interface between collar 38 and keyed aperture 48 of contact holding member 46 and the biasing of compression spring 42 maintains contact 50 downwardly against contact 70 and in an axially stable position while it rotates. As a result, the switch contacts make a clean make-and-break connection with the fixed contacts 80 and 90 during the operation of the switch instead of the momentary flicker experienced by the axially moveable contacts of the prior art. Further, the rotary wiping of contacts 53 which extend as seen in FIG. 4 slightly radially or laterally outwardly from the edge of contact holder 46 tends to clean the contacts as they engage elements 87 and 97 of the respective contacts 80 and 90. In order to promote the connection between the rotary moveable contact 50 and the circular end 73 of conductor 70, end 73 may be crowned to provide a greater contact force between contact 70 and contact 50. These and other modifications to the preferred embodiment described herein can be made by those skilled in the art without departing from the spirit or scope of the invention as defined by the appended claims.

The embodiments of the invention in which an exclusive property or privilege is claimed are defined as follows:

1. A push-button switch comprising:

a switch housing;

plunger means mounted in said housing for sliding movement along a first axis and including means for converting said sliding movement of a portion of said plunger means to a rotary movement around said axis;

a contact holder for receiving a moveable switch contact, said contact holder including means for slideably receiving a portion of said plunger means and means for keying said holder to said position of said plunger means for rotation therewith, said moveable switch contact including a contact member extending laterally from said first axis, said contact member of said moveable contact having an end extending in an axial direction generally parallel to said first axis; and at least one fixed contact mounted in said housing in position to be selectively engaged by said contact member at a predetermined rotational position of said moveable contact, said fixed contact being generally U-shaped with one leg of said fixed contact secured to said housing and the remaining leg extending radially inwardly to engage said contact holder and selectively engage said contact member of said moveable contact when aligned therewith, said one leg of said contact being generally I-shaped and including spaced and tips for mounting said fixed contact to said housing.

2. The switch as defined in claim 1, wherein said remaining leg of said fixed contact includes a dimple extending radially inwardly to provide a contact point with said contact member of said moveable contact.

3. The switch as defined in claim 2, wherein said contact holder includes an axially extending recess into which said axially extending end of said contact member extends for support.

4. In a push-button switch of the type including a housing with a ratchet mechanism for converting the longitudinal movement of a push-button plunger into a rotary motion, an improved switch contact assembly comprising:

a contact holder slideably keyed to a rotatable portion of the plunger of the push-button switch for rotation of said holder as said push-button plunger is actuated;

moveable contact means mounted to said holder for movement therewith and including at least one laterally and longitudinally extending contact member;

fixed contact means mounted in the housing in relationship to said moveable contact means such that said contact member engages said fixed contact means at a predetermined rotational position of said contact holder, said fixed contact means being generally U-shaped with one leg of said fixed contact means secured to said housing and the remaining leg extending radially inwardly to engage said contact holder and selectively engage said contact member of said moveable contact means when aligned therewith, said one leg of said fixed contact means being generally I-shaped and including spaced end tips for mounting said fixed contact means to said housing; and means for coupling electrical conductors to said moveable contact means and to said fixed contact means.

5. The switch as defined in claim 4, wherein said remaining leg of said fixed contact means includes a dimple extending radially inwardly to provide a contact point with said contact member of said moveable contact means.

6. The switch as defined in claim 5, wherein said contact holder includes an axially extending recess into which said axially extending end of said contact member extends for support.

7. A push-button switch comprising:

a switch housing comprising an upper housing part and a lower housing part;

plunger means mounted in said housing for sliding movement along a first axis and including means for converting said sliding movement of a portion of said plunger means to a rotary movement around said axis;

a cylindrical contact holder receiving a moveable switch contact element, said contact holder including means for slideably receiving a portion of said plunger means and means for keying said holder to said position of said plunger means for rotation therewith, a first fixed contact member having a portion located below said contact holder; said moveable switch contact element including a first portion extending laterally from said first axis for continuous contact with said first fixed contact member below said cylindrical contact holder, said moveable contact element having a second end portion extending in an axial direction generally parallel to said first axis and adjacent the periphery of said cylindrical contact holder;

at least one second fixed contact member mounted in said housing on an inner wall of at least one of said upper and lower housing parts and in position to be selectively engaged by said second end portion of said contact element at a predetermined rotational position of said moveable contact element, said second fixed contact member being generally shaped to provide one leg of said second fixed contact member abutting the inner wall of said housing and another leg having a portion thereof spaced radially inwardly from said wall to engage said contact holder and selectively engage said second end portion of said moveable contact element when aligned therewith; a spring located between said plunger means and said contact holder for biasing said laterally extending end portion against said first fixed contact element, and said other leg of said fixed second contact being resilient to bias and wipe said other leg over said second end portion of said contact member as said contact holder is rotated by pushing on said plunger means whereby a clean make-and-break connection is made between said second end portion of said contact element and said other leg of said second fixed contact member and a continuous biased electrical connection is made between said laterally extending first portion of said moveable contact element and said first fixed contact member.

8. The switch as defined in claim 7, wherein said second fixed contact member is generally U-shaped with one leg of said second fixed contact member secured to said housing and the said another leg having a portion thereof extending radially inwardly to engage said contact holder and selectively engage said second end portion of said moveable contact element when aligned therewith.

9. The switch as defined in claim 7, wherein said moveable switch contact element includes a plurality of arcuately spaced second end portions and wherein said housing includes a plurality of spaced second fixed contact members positioned to selectively engage said second end portions as said moveable switch contact element is rotated.

10. The switch as defined in claim 1, wherein said moveable switch contact element and said cylindrical contact holder do not move relative to each other upon said cylindrical contact holder receiving said moveable switch contact element.

11. In a push-button switch of the type including a housing formed of two halves, at least one half having side walls and an end wall; at least one recess formed in one of said side walls and extending in a direction along said side wall between said top and bottom walls;

a push-button plunger mounted in said housing for sliding movement along a first axis;

a ratchet mechanism for converting the longitudinal movement of said push-button plunger into a rotary motion around said axis;

a cylindrical contact holder slideably keyed to a rotatable portion of the plunger of the push-button switch for rotation of said holder as said push-button plunger is actuated;

a first fixed contact member having a portion located below said contact holder;

moveable contact means mounted to said cylindrical contact holder for movement therewith and including at least one moveable switch contact element including a first portion extending laterally from said first axis for continuous contact with said first fixed contact member below said cylindrical contact holder, said moveable contact element having a second end portion extending in an axial direction generally parallel to said first axis and adjacent the periphery of said cylindrical contact holder;

at least one second fixed contact member mounted in said housing in relationship to said moveable contact means such that said second fixed contact member engages said second end portion of said contact element at a predetermined rotational position of said contact holder and moveable contact element, said second fixed contact means being generally shaped to provide one leg of said second fixed contact member abutting the inner wall of said housing and another leg having a portion thereof extending radially inwardly so as to be spaced inwardly from said wall to engage said contact holder and selectively engage said second end portion of said moveable contact element when aligned therewith, said one leg of said fixed contact means being generally shaped to include at least one tip generally orthogonally to said one leg and extending into said recess for positioning said second fixed contact means in said housing;

a spring located between said plunger means and said contact holder for biasing said laterally extending end portion against said first fixed contact element, and said other leg of said fixed second contact being resilient to bias and wipe said other leg over said second end portion of said contact member as said contact holder is rotated by pushing on said plunger means whereby a clean make-and-break connection is made between said second end portion of said contact element and said other leg of said second fixed contact member and a continuous biased electrical connection is made between said laterally extending first portion of said moveable contact element and said first fixed contact member; and means for coupling electrical conductors to said moveable contact means and to said fixed contact means.

12. The switch as defined in claim 11, wherein said moveable switch contact element includes a plurality of arcuately spaced second end portions and wherein said housing includes a plurality of spaced second fixed contact members positioned to selectively engage said second end portions as said moveable switch contact element is rotated.

13. The switch as defined in claim 11, wherein said second fixed contact member is generally U-shaped with one leg of said second fixed contact member secured to said housing and said another leg having a portion thereof extending radially inwardly to engage said contact holder and selectively engage said second end portion of said moveable contact element when aligned therewith.

14. The switch as defined in claim 11, wherein said moveable switch contact element and said cylindrical contact holder do not move relative to each other upon said cylindrical contact holder receiving said moveable switch contact element.

* * * * *

UNITED STATES PATENT AND TRADEMARK OFFICE

CERTIFICATE OF CORRECTION

PATENT NO. : 4,996,401

DATED : February 26, 1991

INVENTOR(S) : Sung-Taek Park

It is certified that error appears in the above-identified patent and that said Letters Patent is hereby corrected as shown below:

Claim 1, line 15,
"and tips" should be --end tips--.

Signed and Sealed this

Eighteenth Day of August, 1992

*Attest:*

DOUGLAS B. COMER

*Attesting Officer*

*Acting Commissioner of Patents and Trademarks*